US005236139A

United States Patent [19]

Radtke

[11] Patent Number: 5,236,139

[45] Date of Patent: Aug. 17, 1993

[54] WEAR ADJUSTABLE SHREDDER

[75] Inventor: John A. Radtke, Atlanta, Mich.

[73] Assignee: Ameri-Shred Industrial Corp., Alpena, Mich.

[21] Appl. No.: 926,515

[22] Filed: Aug. 10, 1992

[51] Int. Cl.[5] ..... B02C 18/18

[52] U.S. Cl. ..... 241/236; 241/286; 241/295

[58] Field of Search ..... 241/236, 286, 295; 83/502

[56] References Cited

U.S. PATENT DOCUMENTS

| | | | |
|---|---|---|---|
| 4,280 | 11/1845 | Bogardus . | |
| 138,606 | 5/1873 | Borgfeldt | 241/236 |
| 1,178,386 | 4/1916 | Edwards . | |
| 1,994,137 | 3/1935 | Leguillon . | |
| 2,006,106 | 6/1935 | Markert . | |
| 2,770,302 | 11/1956 | Lee . | |
| 3,797,765 | 3/1974 | Samuels | 241/236 |
| 3,894,697 | 7/1975 | Lawson et al. | 241/159 |
| 3,960,335 | 6/1976 | Haberle | 241/236 |
| 4,018,392 | 4/1977 | Wagner | 241/167 |
| 4,026,176 | 5/1977 | Weiskopf | 83/502 |
| 4,428,265 | 1/1984 | Bolton | 83/502 |
| 5,152,469 | 10/1992 | Dicky | 241/236 |

FOREIGN PATENT DOCUMENTS

| | | | |
|---|---|---|---|
| 30777 | 3/1885 | Fed. Rep. of Germany | 83/502 |
| 0063684 | 6/1978 | Japan | 241/236 |

*Primary Examiner*—Mark Rosenbaum
*Assistant Examiner*—John M. Husar
*Attorney, Agent, or Firm*—Warner, Norcross & Judd

[57] ABSTRACT

A wear adjustable shredder having spaced apart, parallel rotating shafts, series of interleaved and overlapping cutter disks carried on the shafts, and an adjustable cutter disk assembly carried endmost on one of the shafts, the adjustable cutter disk assembly having an inner adjusting ring and an outer cutting ring with the cutting ring threaded on the adjusting ring. The cutting ring may be rotated with respect to the adjusting ring such that the ring moves axially toward or away from the cutter disks to adjust the spacing of the cutter disks.

23 Claims, 3 Drawing Sheets

WEAR ADJUSTABLE SHREDDER

BACKGROUND OF THE INVENTION

1. Field of the Invention

The present invention relates to shredders and, more particularly, to a shredder having wear adjustable cutter disks.

2. Description of the Related Art

Shredders are known in which two series of interleaved cutter or slitter disks are each mounted on parallel, spaced apart, counter-rotating shafts. The circumferences of the disks on one shaft are overlapped with the disks on the other shaft such that material fed into the nip formed at the overlap of the disks is shredded.

It is necessary for the proper functioning of such shredders that the cutter disks carried on the shafts be very closely spaced, or even in contact, with each other at the overlaps therebetween. The disks therefore rub against each other, and against the material being shredded, resulting in wear which reduces the thickness of the disks over time. As the disks become thinner, it is necessary to compensate by providing some means for again bringing the disks close together on the shafts.

In the past, the cutter disks have been axially slidable on the shafts, and bronze wear plates have been wedged against the endmost cutter disks to urge the disks closely together. However, such wear plates wear rapidly and require frequent replacement. Furthermore, the wear plates impart a considerable amount of heat to the assembly through friction, thereby affecting the hardness of the cutter disks.

It is desirable for the wear adjustment device to be mechanically simple, durable, economically constructed, unobtrusive, retrofittable to existing equipment, and easily adjusted.

SUMMARY OF THE INVENTION

The present invention provides a wear adjustable shredder in which one or both of the endmost cutter disks is a concentric assembly of an inner adjusting ring threaded on its outer circumference and an outer cutting ring threaded on its inner circumference. The threads of the adjusting ring mate with the threads of the cutting ring. The axial position of the cutting ring is adjusted by rotating the cutting ring relative to the adjusting ring. By so rotating the cutting ring, the cutting disks are brought more closely together to compensate for the reduction in thickness caused by the cutting disks rubbing together.

According to the invention, the outer circumference of the adjusting ring is formed with several circumferentially spaced apart, axially elongated slots or recesses. The cutting ring is formed with several radial tapped and counterbored holes in correspondence with the recesses of the adjusting ring. Screws are inserted into the holes of the cutting ring such that the screws engage the recesses of the adjusting ring, thereby preventing rotation of the cutting ring relative to the adjusting ring. To make a wear adjustment, the screws are loosened, the cutting ring is turned on the adjusting ring, and the screws are retightened.

The structure of the inner portion of the adjusting ring is similar to the inner portion of a standard cutter disk. The structure of the outer portion of the cutting ring is similar to the outer portion of a standard cutter disk. Therefore, the adjustable cutter disk assembly of the invention is readily and economically retrofittable to existing shredding equipment.

Since the adjustable cutter disk assemblies are functioning cutter disks, the full width of the shredder is available for shredding action. The elimination of bronze wear plates also eliminates the heat generation problems of such wear plates.

These and other objects, advantages, and features of the present invention will be more fully understood and appreciated by reference to the written specification and appended drawings.

DESCRIPTION OF THE PREFERRED EMBODIMENT

Figure 1:
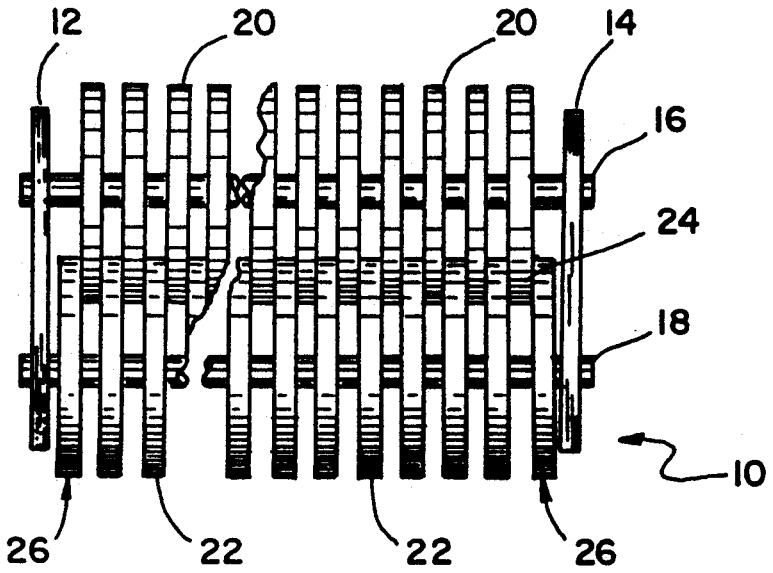
FIG. 1 is a front elevational view of a wear adjustable shredder according to the principles of the invention.

By way of disclosing a preferred embodiment, and not by way of limitation, there is shown in FIG. 1 a wear adjustable shredder 10 which includes in its general organization a supporting structure having a pair of spaced-apart end plates 12, 14, a first, or upper, rotating shaft 16 and a parallel second, or lower, rotating shaft 18 both extending between the end plates, a plurality of upper cutter disks 20, and a plurality of lower cutter disks 22. The shafts are spaced apart by a distance less than the diameter of the cutter disks. The shafts 16 and 18 pass through center holes in each of the cutter disks 20, 22 such that the cutter disks are carried on the shafts and are able to slide axially on the shafts without canting. The cutter disks are keyed to the shafts. The spacing of the shafts and the diameter of the cutter disks are such that the cutter disks are interleaved and overlapped to form a nip 24. A motor and suitable drive mechanism (not shown) are provided to forcibly counter-rotate the cutter disks such that material fed into the nip is shredded or cut.

The spacing of the shafts and the diameter of the cutter disks are such that the cutter disks are interleaved and overlapped to form a nip 24. In order for the shredder to operate properly, the cutter disks must be in contact with each other or very closely spaced. As a result, the overlapping outer annular portions of the flat surfaces of the cutter disks rub together. This rubbing causes the cutter disks to become thinner. It is then necessary to again bring the cutter disks close together to compensate for the wear. It is this adjustment with which the present invention is concerned.

The endmost cutter disks carried on the lower shaft 18 are adjustable cutter disk assemblies 26. With this arrangement, both cutter disk assemblies 26 may be adjusted to keep the cutter disk assemblies centered between the end plates or on the shaft. The use of two cutter disk assemblies also provides a greater range of adjustment. However, it is optional and within the scope of the invention to use only a single cutter disk assembly 26 outermost at only one end of a shaft. Also, the cutter disk assembly may be placed on the top shaft, or on either one of side by side shafts in a top feed arrangement.

Figure 2:
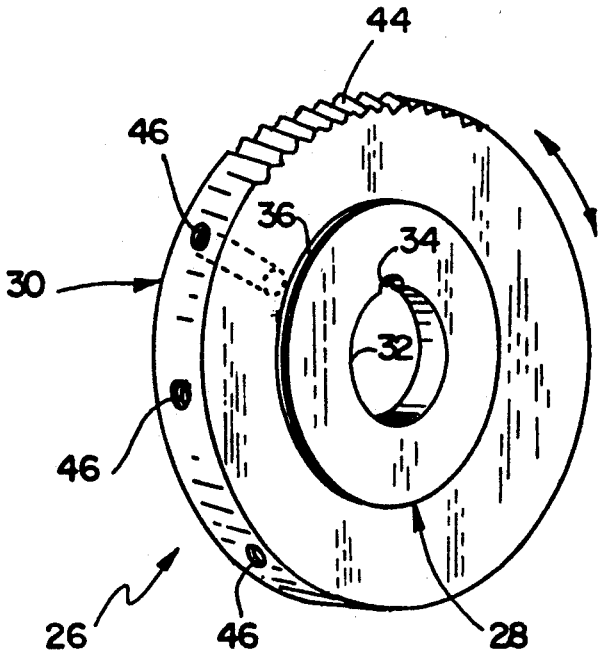
FIG. 2 is a perspective view of an adjustable cutter disk assembly.

As shown in FIG. 2 each adjustable cutter disk assembly 26 includes an inner adjusting ring 28 and an outer cutting ring 30 encircling and concentric with the adjusting ring 28 and with the shaft on which the adjusting ring is carried.

Figure 3:
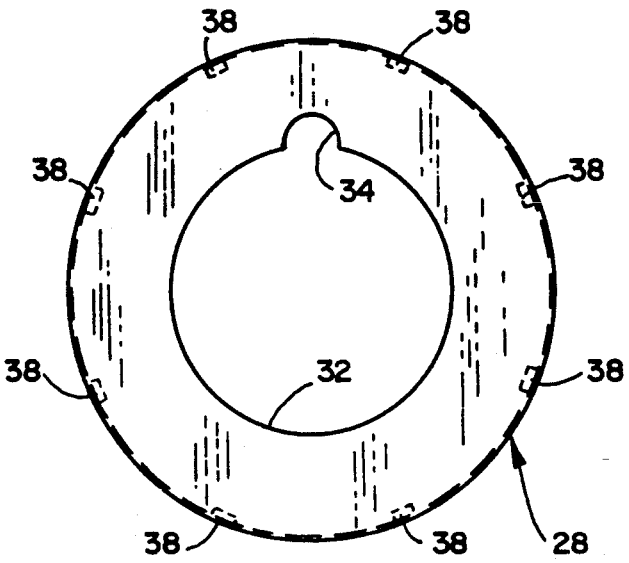
FIG. 3 is a side view of the adjusting ring.
Figure 4:
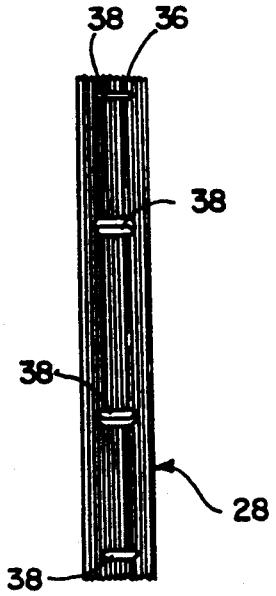
FIG. 4 is a front view of the adjusting ring.

Referring also to FIGS. 3 and 4, the adjusting ring 28 is formed with a center hole 32 having a diameter slightly larger than the diameter of the shaft 18 on which the adjusting ring is carried such that the adjusting ring can slide axially on the shaft without canting. A semicircular recess 34 is formed in the inner circumference of the adjusting ring to mate with a cylindrical key rod as discussed more fully below.

The outer circumferential surface of the adjusting disk 32 is formed with helical threads 36. The outer circumferential surface of the adjusting disk is further formed with eight evenly spaced recesses 38. More or fewer recesses may be employed. Each recess 38 is axially elongated, extending across most of the width of the circumferential surface of the adjusting disk.

Figure 5:
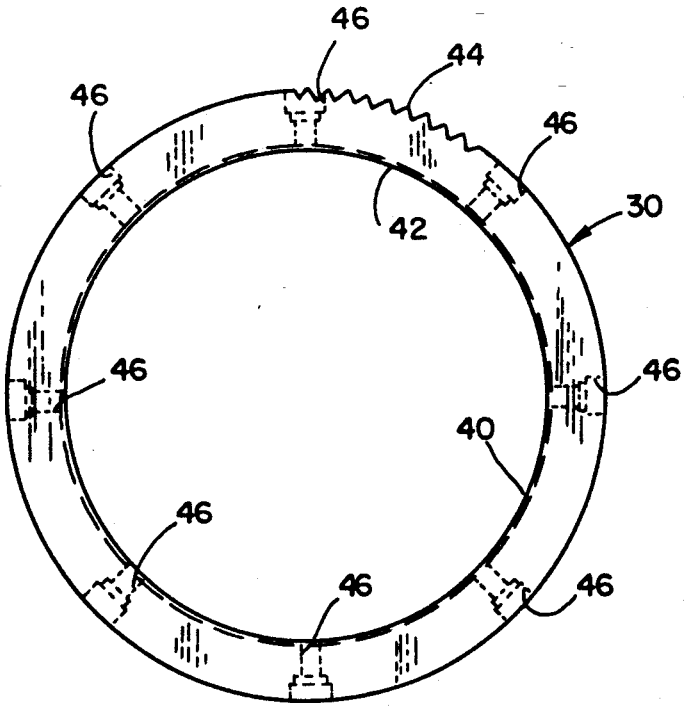
FIG. 5 is a side view of the cutting ring.
Figure 6:
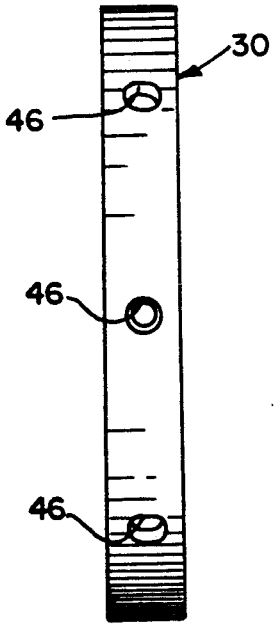
FIG. 6 is a front view of the cutting ring.

Referring to FIGS. 2, 5, and 6, cutting ring 30 has an inner diameter substantially equal to the outer diameter of adjusting disk 32. The inner circumferential surface 38 of the cutting ring is formed with helical threads 42 (see also FIG. 7) which mate with the threads 36 of the adjusting disk 28. The outer circumferential surface of the cutting ring 30 is formed with teeth 44. Alternatively, the outer circumferential surface 30 may be left smooth if, for example, the shredder is to be used for slitting.

Figure 9:
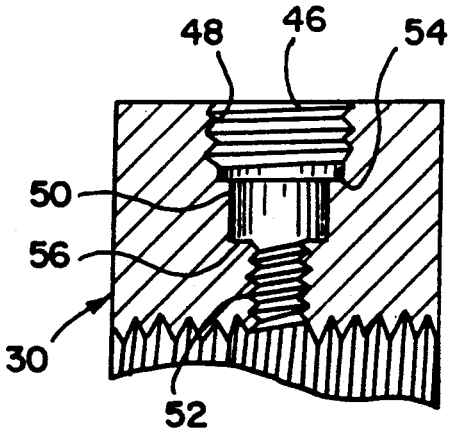
FIG. 9 is a fragmentary, sectional view of the cutting ring showing details of the cutting ring holes.

Cutting ring 30 is formed with eight evenly spaced, radially extending holes 46. Thus, cutting ring holes 46 coincide with the recesses 38 of the adjusting ring 28. Details of the cutting ring holes 46 are shown in FIG. 9. Each hole 46 includes a tapped outer portion 48, an untapped intermediate portion 50 having a diameter smaller that the diameter of the outer portion 48, and a tapped inner portion 52 having a diameter smaller than the diameter of the intermediate portion 50. An outer shoulder 54 is formed between outer portion 48 and intermediate portion 50. An inner shoulder 56 is formed between intermediate portion 50 and inner portion 52.

Figure 8:
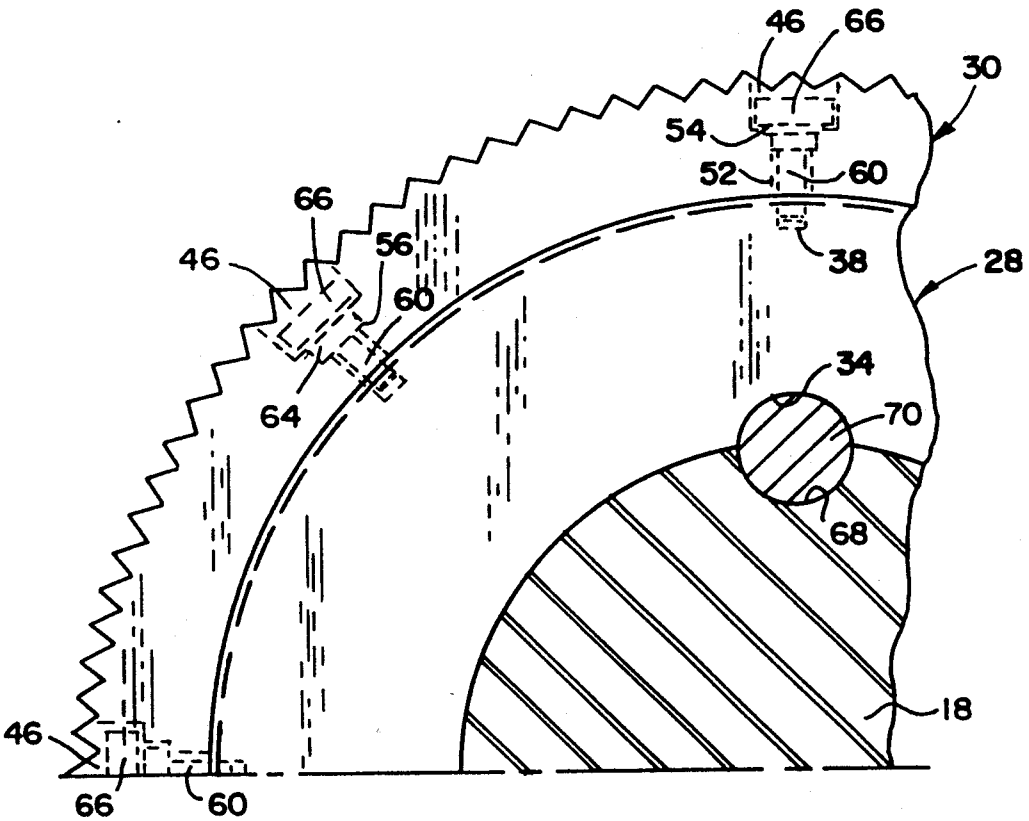
FIG. 8 is a side view of the cutter disk assembly and shaft taken substantially along the line 8—8 of FIG. 7.
Figure 7:
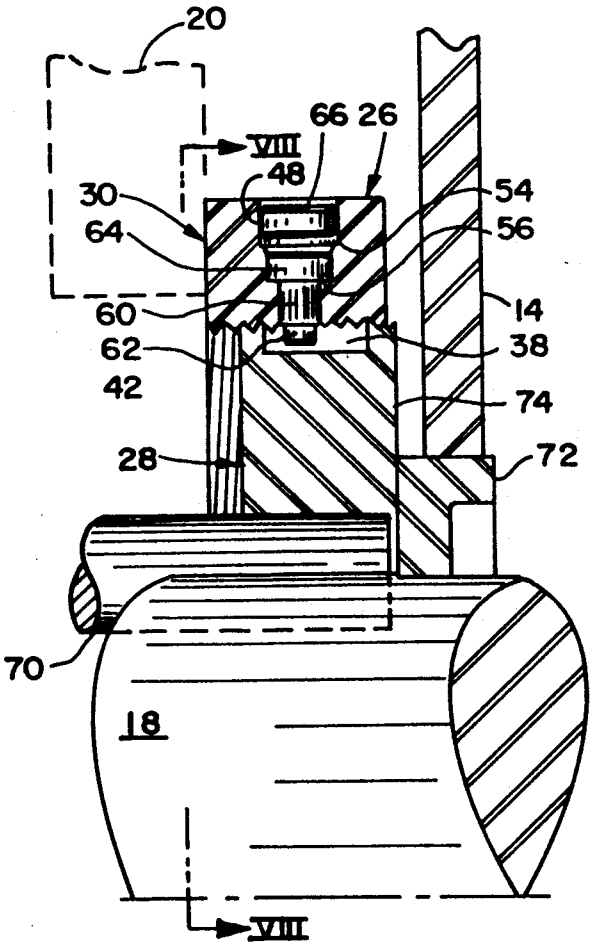
FIG. 7 is a fragmentary, front view, with parts in vertical section, of an adjustable cutter disk assembly mounted on the end of a shaft.

As shown in FIGS. 7 and 8, socket head cap screws 60 are threaded into the inner portion 52 of each hole 46 of the cutting ring. In order to lock the cutting ring so that it does not rotate relative to the adjusting ring, the tip 62 of each socket head cap screw 60 protrudes through the cutting ring 30 into one of the slots 38 of the adjusting ring 28. Socket head cap screw 60 is tightened such that the underside of the cap 64 of each socket head cap screw is tight against the inner shoulder 56 to limit the distance by which the tip 62 protrudes.

A plug in the form of disk-like socket set screw 66 is threaded into the outer portion 48 of each cutting disk hole. Each socket set screw 66 is tightened such that the underside of the socket set screw is tight against the outer shoulder 54 of the hole 46. The socket set screws 66 capture the socket head cap screws 60 within the holes 46 and prevent unwanted withdrawal of the socket head cap screws.

The lower shaft 18 on which the adjustable cutter disk assemblies 26 are carried is formed with an axial semi-cylindrical recess 68. The recess 34 of the adjusting disk is aligned with the recess 68 of the shaft 18 and a cylindrical key rod 70 passes through the opening thus formed. Key rod 70 locks the cutter disk assembly 26, as well as the other cutter disks on the shaft, to the shaft 18 such that the cutter disk assembly is drivingly rotated by the shaft 18. The key rod 70 may have other shapes, such as square or rectangular.

As shown in FIG. 7, bearing spacer 72 is fixed directly or indirectly to the end plate 14. Bearing spacer 72 and end plate cooperatively retain the cutter disk assembly 26 on the shaft 18. Bearing spacer 72 contacts the adjacent surface 74 of the adjusting ring 28 and provides an axial reaction force urging the adjusting ring toward the opposite end plate.

To adjust the spacing of the shredder disks, all of the socket head set screws 66 are removed from the holes 46 of the cutting ring 30. Next, all of the socket head cap screws 60 are loosened until their tips 62 are disengaged from the slotted recesses 60 of the adjusting ring 28. Then, with the shaft 18 and adjusting ring 28 held stationary, the cutting ring 30 is rotated, thus causing the cutting ring to move axially toward or away from the cutting disks 20, 22 on the shafts. When the desired adjustment has been obtained, the cutting ring is further rotated to bring each hole 46 into alignment with the nearest recess 38. The socket head cap screws 60 are tightened to engage the recesses 38 and lock the axial adjustment of the cutter disk assembly 26. Finally, the socket head set screws 66 are replaced. If two cutter disk assemblies 26 are used, as in FIG. 1, each assembly may be adjusted to keep the series of cutter disks centered on the shafts.

It has been found that SAE 4150 is a suitable material for the adjusting ring, and that A2 hardened tool steel is suitable for the cutting ring.

With an adjusting ring having a nominal outer diameter of ten inches, the threads on the outer circumferential surface of the adjusting ring are suitably formed at ten threads per inch. With these specifications, one-eighth of a rotation of the cutting ring with respect to the adjusting ring yields an axial adjustment of 0.012 inch. The assembly may then be used to allow a desirable disk spacing with no more than 0.015 inch between any two cutter disks.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. In a shredder of the type having spaced apart, rotating shafts, each of the shafts carrying a series of axially freely slidably cutting disks with the cutting disks of one shaft interleaved and overlapped with the cutting disks of the other shaft, the combination therewith of a cutter disk assembly comprising:

an adjusting ring carried endmost on an axially extending portion of one of the shafts and having a threaded outer circumferential surface, said series of axially freely slidable cutting disks carried on said one of the shafts disposed axially spaced apart from said adjustment ring;

a cutting ring encircling said adjusting ring and having a threaded inner circumferential surface engaging the threaded outer circumferential surface of said adjusting ring; and means for selectably releasing said cutting ring for rotation with respect to said adjusting ring and thereby axial movement with respect to said adjusting ring and for locking said cutting ring against rotation with respect to said adjusting ring.

2. An adjustable cutter disk for a shredder comprising:

an adjusting ring having a central hole for the passage of a rotating shaft and a threaded outer circumferential surface;

a cutting ring encircling said adjusting ring and having a threaded inner circumferential surface engaging the outer circumferential surface of said adjusting ring, said adjusting ring adapted to be carried on an axially extending portion of the rotating shaft and having an axial thickness substantially the same as the thickness of said cutting ring;

means for selectably releasing said cutting ring for rotation with respect to said adjusting ring and thereby axial movement with respect to said adjusting ring and for locking said cutting ring against rotation with respect to said adjusting ring.

3. The adjustable cutter disk of claim 2 further comprising means formed in said central hole of said adjusting disk for keying said adjusting disk for corotation with a rotating shift.

4. A wear adjustable shredder comprising:

first and second rotating shafts;

a supporting structure supporting said first and second shafts in parallel, spaced apart relationship;

a first series of cutting disks carried on said first shaft and axially slidable thereon;

a second series of cutting disks carried on said second shaft and axially freely slidable thereon, said second series of cutting disks being interleaved and overlapping with said first series of cutting disks; and at least one cutting disk assembly carried endmost on said second shaft and comprising:

an adjusting ring encircling an axially extending portion of said second shaft and disposed axially spaced apart from said second series of cutting disks, said adjusting ring having a threaded outer circumferential surface;

a cutting ring encircling said adjusting ring and having a threaded inner circumferential surface engaging the outer circumferential surface of said adjusting ring; and means for selectably releasing said cutting ring for rotation with respect to said adjusting ring and for locking said cutting ring against rotation with respect to said adjusting ring;

whereby rotation of said cutting ring with respect to said adjusting ring causes said cutting ring to move axially toward or away from said second series of cutting disks.

5. The wear adjustable shredder of claim 4 further comprising a second said cutting disk assembly carried endmost on said second shaft opposite said at least one cutting disk assembly.

6. The wear adjustable shredder of claim 4 further comprising means for urging said cutting disk assembly axially toward said second series of cutting disks.

7. In a shredder of the type having spaced apart, rotating shafts, each of the shafts carrying a series of axially slidable cutting disks with the cutting disks of one shaft interleaved and overlapped with the cutting disks of the other shaft, the combination therewith of a cutter disk assembly comprising:

an adjusting ring carried endmost on one of the shafts and having a threaded outer circumferential surface;

a cutting ring encircling said adjusting ring and having a threaded inner circumferential surface engaging the threaded outer circumferential surface of said adjusting ring; and means for selectably releasing said cutting ring for rotation with respect to said adjusting ring and thereby axial movement with respect to said adjusting ring and for locking said cutting ring against rotation with respect to said adjusting ring, said means for selectably releasing comprising at least one radial hole formed through said cutting ring and a withdrawable fastener extending through said hole and engaging said outer circumferential surface of said adjusting ring.

8. The combination of claim 7 wherein said outer circumferential surface of said adjusting ring is formed with at least one recess, and wherein said fastener extends into said recess when said cutting ring is locked against rotation with respect to said adjusting ring.

9. The combination of claim 8 wherein said recess is axially elongated.

10. In a shredder of the type having spaced apart, rotating shafts, each of the shafts carrying a series of axially slidable cutting disks with the cutting disks of one shaft interleaved and overlapped with the cutting disks of the other shaft, the combination therewith of a cutter disk assembly comprising:

an adjusting ring carried endmost on one of the shafts and having a threaded outer circumferential surface;

a cutting ring encircling said adjusting ring and having a threaded inner circumferential surface engaging the threaded outer circumferential surface of said adjusting ring; and means for selectably releasing said cutting ring for rotation with respect to said adjusting ring and thereby axial movement with respect to said adjusting ring and for locking said cutting ring against rotation with respect to said adjusting ring, wherein said means for selectably releasing comprises a plurality of circumferentially spaced apart radial holes formed through said cutting ring, a plurality of circumferentially spaced apart recesses formed in said circumferential surface of said adjusting ring in correspondence with said holes, and a plurality of withdrawable fasteners, each of said fasteners extending through one of said holes and into one of said recesses thereby to lock said cutting ring against rotation with respect to said adjusting ring.

11. An adjustable cutter disk for a shredder comprising:

an adjusting ring having a central hole for the passage of a rotating shaft and a threaded outer circumferential surface;

a cutting ring encircling said adjusting ring and having a threaded inner circumferential surface engaging the outer circumferential surface of said adjusting ring;

means for selectably releasing said cutting ring for rotation with respect to said adjusting ring and thereby axial movement with respect to said adjusting ring and for locking said cutting ring against rotation with respect to said adjusting ring, said means for selectably releasing and locking comprising at least one radial hole formed through said cutting ring and a withdrawable fastener extending through said hole and engaging said outer circumferential surface of said adjusting ring.

12. The adjustable cutter disk of claim 11 wherein said outer circumferential surface of said adjusting ring is formed with at least one recess, and wherein said fastener extends into said recess when said cutting ring is locked against rotation with respect to said adjusting ring.

13. The adjustable cutter disk of claim 12 wherein said recess is axially elongated.

14. An adjustable cutter disk for a shredder comprising:

an adjusting ring having a central hole for the passage of a rotating shaft and a threaded outer circumferential surface;

a cutting ring encircling said adjusting ring and having a threaded inner circumferential surface engaging the outer circumferential surface of said adjusting ring;

means for selectably releasing said cutting ring for rotation with respect to said adjusting ring and thereby axial movement with respect to said adjusting ring and for locking said cutting ring against rotation with respect to said adjusting ring, said means for selectably releasing comprising a plurality of circumferentially spaced apart radial holes formed through said cutting ring, a plurality of circumferentially spaced apart recesses formed in said outer circumferential surface of said adjusting ring in correspondence with said holes, and a plurality of withdrawal fasteners, each of said fasteners extending through one of said holes and into one of said recesses thereby to lock said cutting ring against rotation with respect to said adjusting ring.

15. The adjustable cutter disk of claim 14 further comprising a plurality of plugs, each of said plugs received in one of said holes disposed radially outwardly of a said fastener to prevent unwanted withdrawal of said fastener.

16. The adjustable cutter disk of claim 14 further comprising means formed in said central hole of said adjusting disk for keying said adjusting disk for corotation with a rotating shaft.

17. A wear adjustable shredder comprising:

first and second rotating shafts;

a supporting structure supporting said first and second shafts in parallel, spaced apart relationship;

a first series of cutting disks carried on said first shaft and axially slidable thereon;

a second series of cutting disks carried on said second shaft and axially slidable thereon, said second series of cutting disks being interleaved and overlapping with said first series of cutting disks; and at least one cutting disk assembly carried endmost on said second shaft and comprising:

an adjusting ring having a center hole for the passage of said second shaft and a threaded outer circumferential surface;

a cutting ring encircling said adjusting ring and having a threaded inner circumferential surface engaging the outer circumferential surface of said adjusting ring; and means for selectably releasing said cutting ring for rotation with respect to said adjusting ring and for locking said cutting ring against rotation with respect to said adjusting ring, said means for selectably releasing comprising at least one radial hole formed through said cutting ring and a withdrawable fastener extending through said hole and engaging said outer circumferential surface of said adjusting ring;

whereby rotation of said cutting ring with respect to said adjusting ring causes said cutting ring to move axially toward or away from said second series of cutting disks.

18. The wear adjustable shredder of claim 17 further comprising a second said cutting disk assembly carried endmost on said second shaft opposite said at least one cutting disk assembly.

19. The wear adjustable shredder of claim 17 further comprising means for urging said cutting disk assembly axially toward said second series of cutting disks.

20. The wear adjustable shredder of claim 17 wherein said outer circumferential surface of said adjusting ring is formed with at least one recess, and wherein said fastener extends into said recess when said cutting ring is locked against rotation with respect to said adjusting ring.

21. The wear adjustable shredder of claim 20 wherein said recess is axially elongated.

22. A wear adjustable shredder comprising:

first and second rotating shafts;

a supporting structure supporting said first and second shafts in parallel, spaced apart relationship;

a first series of cutting disks carried on said first shaft and axially slidable thereon;

a second series of cutting disks carried on said second shaft and axially slidable thereon, said second series of cutting disks being interleaved and overlapping with said first series of cutting disks; and at least one cutting disk assembly carried endmost on said second shaft and comprising:

an adjusting ring having a center hole for the passage of said second shaft and a threaded outer circumferential surface;

a cutting ring encircling said adjusting ring and having a threaded inner circumferential surface engaging the outer circumferential surface of said adjusting ring; and means for selectably releasing said cutting ring for rotation with respect to said adjusting ring and for locking said cutting ring against rotation with respect to said adjusting ring, said means for selectably releasing comprising a plurality of circumferentially spaced apart radial holes formed through said cutting ring, a plurality of circumferentially spaced apart, axially elongated recesses formed in said outer circumferential surface of said adjusting ring in correspondence with said holes, and a plurality of withdrawable fasteners, each of said fasteners extending through one of said holes and into one of said recesses thereby to lock said cutting ring against rotation with respect to said adjusting ring;

whereby rotation of said cutting ring with respect to said adjusting ring causes said cutting ring to move axially toward or away from said second series of cutting disks.

23. The adjustable cutter disk of claim 22 further comprising a plurality of plugs, each of said plugs received in one of said holes disposed radially outwardly of a said fastener to prevent unwanted withdrawal of said fastener.

* * * * *

UNITED STATES PATENT AND TRADEMARK OFFICE

CERTIFICATE OF CORRECTION

PATENT NO. : 5,236,139

DATED : August 17, 1993

INVENTOR(S) : John A. Radtke

It is certified that error appears in the above-indentified patent and that said Letters Patent is hereby corrected as shown below:

Column 4, claim 1, line 61:
"slidably" should be --slidable--

Column 5, claim 1, line 2:
"adjustment" should be --adjusting--

Column 5, claim 3, line 34:
"shift" should be --shaft--

Column 7, claim 14, line 43:
"withdrawal" should be --withdrawable--

Signed and Sealed this

Twelfth Day of April, 1994

Bruce Lehman

*Attest:*

BRUCE LEHMAN

*Attesting Officer*

*Commissioner of Patents and Trademarks*